US005682723A

United States Patent [19]

Nowotarski et al.

[11] Patent Number: 5,682,723

[45] Date of Patent: Nov. 4, 1997

[54] TURBO-LAMINAR PURGING SYSTEM

[75] Inventors: Mark Stephen Nowotarski, Stamford, Conn.; Jana Sue Haisley, Pleasanton, Calif.

[73] Assignee: Praxair Technology, Inc., Danbury, Conn.

[21] Appl. No.: 519,838

[22] Filed: Aug. 25, 1995

[51] Int. Cl.[6] ..... B65B 31/00

[52] U.S. Cl. ..... 53/403; 53/110; 53/510

[58] Field of Search ..... 53/510, 511, 432, 53/403, 110, 79; 99/467, 483; 426/397, 399, 407; 141/1, 4, 11, 48, 63, 64, 70, 286

[56] References Cited

U.S. PATENT DOCUMENTS

| | | | |
|---|---|---|---|
| 4,140,159 | 2/1979 | Domke | 53/510 |
| 4,823,680 | 4/1989 | Nowotarski | 98/36 |
| 4,920,998 | 5/1990 | Deitrick et al. | 137/3 |
| 5,001,878 | 3/1991 | Sanfilippo et al. | 53/510 |
| 5,020,303 | 6/1991 | Vokins | 53/510 |
| 5,071,667 | 12/1991 | Grune et al. | 53/510 |
| 5,195,888 | 3/1993 | Sharma et al. | 432/64 |
| 5,228,269 | 7/1993 | Sanfilippo et al. | 53/510 |
| 5,247,746 | 9/1993 | Johnson et al. | 53/510 |
| 5,364,007 | 11/1994 | Jacobs et al. | 228/42 |
| 5,371,998 | 12/1994 | Johnson et al. | 53/510 |
| 5,417,255 | 5/1995 | Sanfilippo et al. | 53/510 |

*Primary Examiner*—John Sipos
*Assistant Examiner*—Ed Tolan
*Attorney, Agent, or Firm*—Stanley Ktorides

[57] ABSTRACT

Apparatus and method for purging air from open containers having a processing zone through which the containers are conveyed entering through an entrance point opening and exiting through an exit point during a residence time, including an injector for injecting a turbulent flow of purge gas into the processing zone and means for providing a laminar flow of purging gas into the processing zone, wherein the open portion of the container is exposed to the turbulent purge gas flow for at least 50 percent of the residence time.

13 Claims, 3 Drawing Sheets

Fig. 1
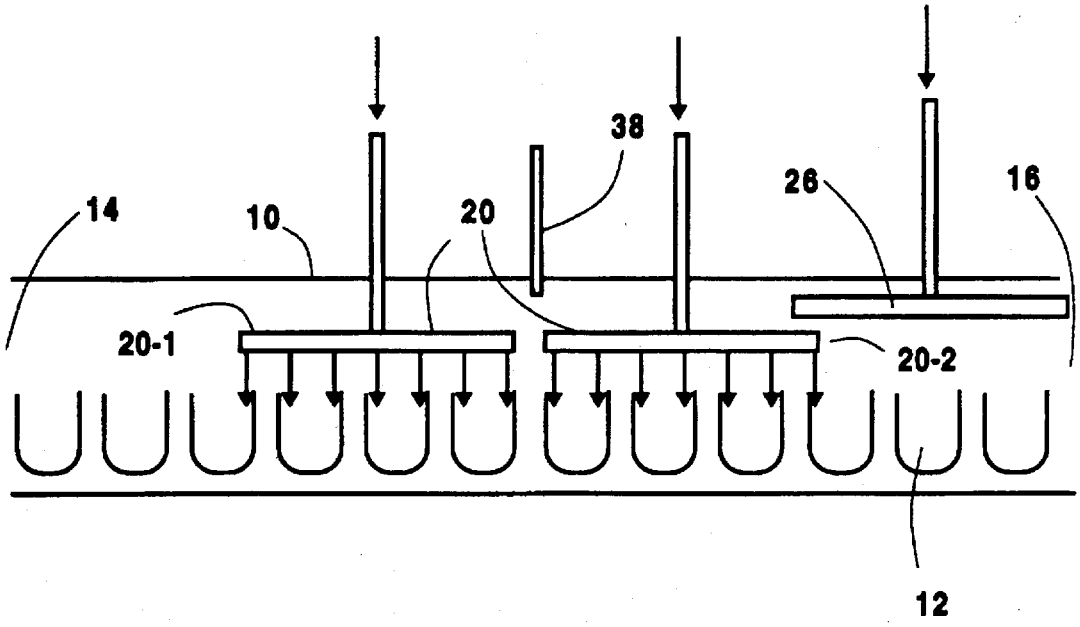
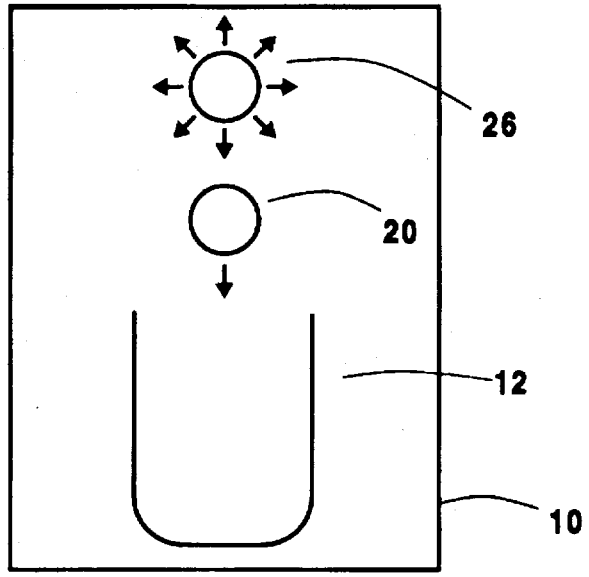
Fig. 2

TURBO-LAMINAR PURGING SYSTEM

FIELD OF THE INVENTION

This invention relates to a system wherein containers holding various types of products are processed to purge them of residual air and other gases, and more particularly to a purging system wherein purging gas is supplied in both turbulent and laminar flow patterns.

BACKGROUND OF THE INVENTION

In the processing of containers, such as bags, cans and tubes, holding various types of products, such as food and cosmetics, the container is often purged to remove residual gas, such as air containing oxygen, prior to final container sealing. Removing air from the container lowers its residual oxygen content. This reduces adverse interaction with the container contents after the container is sealed for shipping and storage; enhances the integrity of the container contents; and increases the shelf life of the various products. In most such applications, it is desired to reduce the oxygen content in the container to about 1% or less before final sealing.

Several processes and systems are known for purging air from containers. One of these is a so-called vacuum and backflush process. Here, the air in the container holding the product is first exhausted by a vacuum. The air-exhausted container is then filled with an inert gas such as nitrogen and is sealed. While this process is effective, the equipment required is relatively complicated and expensive. Also, separate exhausting and filling processing steps are required. This decreases packaging speed and increases overall cost of the product being packaged.

In another process, the containers are passed through a tunnel filled with an inert gas, such as nitrogen or carbon dioxide. While in the tunnel the container interior is subjected to a high velocity turbulent gas flow to purge it of the contained air. This process has a disadvantage in that the turbulent gas flow causes air containing oxygen present at the tunnel entrance and exit to be moved into the tunnel. This causes contamination of the purge gas in the tunnel with air and thereby limits the lowest level of oxygen that can be present in the container after purging.

Another process introduces purging gas through a porous member into the tunnel at a low velocity in a laminar flow pattern. The laminar flow of purge gas aids in blocking the entry of air into the tunnel. However, this process is not effective in removing air from the interiors of the containers being purged. A long residence time is required for a container in the tunnel to purge it of air and a high quantity of purge gas is required to reduce the container oxygen content to an acceptably low level. This is both time consuming and expensive.

In general, it is desired to provide a system in which the purge gas oxygen content is below about 1.0% to ensure that the oxygen content in the container is also below 1.0%. This permits purging of the containers on a continuous basis without the need for a separate container vacuum exhaustion step.

An object of the invention is to provide an improved system for processing containers in which high velocity turbulent flow purge gas is supplied to purge the containers and a low velocity laminar flow of the purging gas is used to reduce infiltration of air into the tunnel.

SUMMARY OF THE INVENTION

The above and other objects, which will become apparent to those skilled in the art upon a reading of this disclosure, are attained by the present invention, one aspect of which is:

A method for purging air from a container comprising:

(A) passing a container having an open part through a processing zone during a residence time;

(B) passing a laminar flow of purge gas through the processing zone while the container is within the processing zone;

(C) injecting a turbulent flow of purge gas into the processing zone; and (D) exposing the open part of said container to the turbulent flow of purge gas within the processing zone for at least 50 percent of the residence time.

Another aspect of the invention is:

Apparatus for purging air from a container comprising:

(A) a processing zone having an entrance point and an exit point;

(B) means for passing a container having an open part through the processing zone from the entrance point to the exit point during a residence time;

(C) means for providing a laminar flow of purge gas through the processing zone; and (D) means for injecting a turbulent flow of purge gas into the processing zone such that the open part of the container is exposed to the turbulent flow of purge gas within the processing zone for at least 50 percent of the residence time.

In a preferred embodiment of the invention the processing zone within which the turbo-laminar purge occurs is a tunnel. In accordance with this embodiment, a tunnel is provided through which containers are passed for purging of container air. The containers can either be filled with their contents while in the tunnel and thereafter purged of air, or containers already filled with contents are purged. In the tunnel, open containers are subjected to an injected high velocity turbulent flow of purging gas which rapidly purges air from the interiors of the containers. A low velocity laminar purging gas flow is introduced in the chamber to establish a volumetric flow rate such that the purging gas is flowing out of the tunnel, preferably at both its entrance and exit. This reduces the amount of air containing oxygen that can infiltrate into the tunnel from the ambient surroundings and maintains the purge gas within the tunnel at a higher purity concentration. The laminar flow purge gas can be introduced from any location within the tunnel, and preferably from a source near the tunnel exit.

In producing the turbo-laminar purge gas flows, the turbulent gas source is preferably located within the tunnel at a distance of not less than twice the smallest dimension of the tunnel entrance or exit nearest which the turbulent flow gas injector is located. This minimizes the mixing and entrainment of air from outside the tunnel that would contaminate the tunnel purging atmosphere with oxygen. The laminar flow source most preferably has a minimum distance from the adjacent tunnel opening of one-half the smallest dimension of the opening.

The combination of the turbulent and laminar purging gas flows provides for rapid and efficient purging of the containers and also maintains the tunnel purge gas atmosphere at a low oxygen level. Therefore, the containers are more completely purged of oxygen and the processing is rapidly and efficiently completed at relatively low cost.

In a preferred embodiment the turbulent purge gas flow is supplied within the tunnel through two separate injectors. This better balances the injected turbulent gas flow so that there is no bias of gas flow toward either the tunnel entrance or exit.

The defined minimum turbulent purge time, i.e. at least 50 percent of the residence time, enables the invention to achieve significantly improved purging of unwanted gas from the container over conventional practice which provides turbulent purge gas injection into an open container during a short or discrete period while the container is within the processing zone.

BRIEF DESCRIPTION OF THE DRAWINGS

FIG. 1 is a schematic view of a purging tunnel along its length;

FIG. 2 is an end view of the tunnel of FIG. 1;

DETAILED DESCRIPTION OF THE INVENTION

Figure 3:
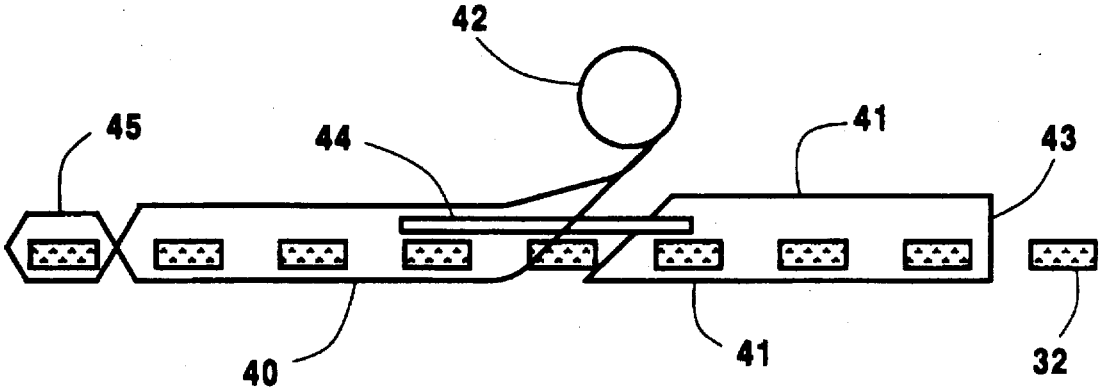
FIG. 3 is a diagrammatic view of a horizontal form fill packaging system with air purging.

Referring to FIGS. 1 and 2, there is a tunnel 10 of any suitable material, e.g., metal, plastic, etc. The tunnel has any desired shape, here shown as being of generally rectangular cross-section. The cross-section of the tunnel is generally made only large enough to accommodate the containers 12 being processed and the associated purge gas injecting apparatus. This minimizes the amount of purge gas that has to be supplied and thereby reduces operational costs.

Open containers 12 are conveyed through the entire length of tunnel 10 from an entrance point at opening 14 to an exit point at opening 16. The time during which a container is within the tunnel or processing zone as it passes form entrance point 14 to exit point 16 is termed its residence time. The conveyance is done either by the containers standing on a moving conveyor (not shown) or being suspended from one. The conveyor apparatus is conventional in the art, and any suitable conveyor can be used. The containers 12 can be of any suitable type, for example, metal cans, cardboard or cardboard/plastic laminate packages in which snack foods are often packaged, open foil or cellophane bags, plastic containers, tubes having an open bottom end, etc. The containers 12 also can be of any size and shape that can be accommodated by the tunnel dimensions and can contain any of a variety of types of products, such as foods, cosmetics, etc.

The open containers 12 entering the tunnel 10 at entrance 14 can be already filled with product or the product can be dispensed into the containers as they enter the tunnel. The container filling can be accomplished by any suitable dispensing apparatus (not shown). Open containers 12 are moved through the length of tunnel 10 during the residence time to purge the air remaining in their interiors before they are sealed. The sealing can take place in a machine (not shown) located closely adjacent to tunnel exit 16 or else within the tunnel itself.

Located within the tunnel 10 somewhat below its roof is a turbulent purge gas injector 20, here shown being in two separate sections 20-1 and 20-2. The gas injectors 20 are supplied with the purging gas, for example, argon or nitrogen, from a suitable source for injection directly into the open tops of the containers 12 as they pass below the injector 20. The injector outlets are preferably relatively close to the container open tops. A simple effective injector for producing turbulent gas flow is a pipe with a row of holes. The holes are made as small as is convenient to fabricate in order to minimize turbulent purge gas flow requirements. The holes should be spaced as far apart as possible, also to minimize turbulent purge gas flow requirements. However, the holes should not be farther apart than the width of the open tops of the containers being purged. This permits continuous communication between the turbulent flow purge gas and the container interiors. If this is not done, the containers will experience times when there is no turbulent purge directed into their interiors and the efficiency of the tunnel in terms of container purging time will be low. The open part of the containers are exposed to the turbulent purge gas flow for at least 50 percent of the residence time, preferably at least 70 percent of the residence time.

The diameter of the pipe for the turbulent injector 20 should be large enough to ensure that the purge gas is distributed uniformly to all of the injector holes. Also, the holes should be oriented to direct the turbulent flow into the containers being purged. Depending upon the shape of the containers and the manner in which they are fed through the tunnel, the gas injector holes can be in multiple rows to ensure turbulent purge gas flow across the entire open tops of the containers.

In a preferred embodiment, no hole of the turbulent purge gas injector 20, that is, no exit orifice of turbulent gas flow, should be closer in distance to either the adjacent tunnel entrance or exit opening 14, 16 by less than the smallest dimension (length or width) of such opening and preferably, no closer than twice the smallest dimension of such opening. This reduces the possibility of air being moved into the tunnel through either the entrance 14 or exit 16 due to turbulence. The turbulent injector 20 is in sections 20-1, 20-2 which are preferably configured as two independently controlled turbulent injectors located in series in a direction along the tunnel length. For tunnels of extended length, more than two turbulent injector sections can be provided. The reason for using independently controlled sections for the turbulent injector 20 is that a single injector tends to slightly bias the gas flow to one tunnel end opening or the other due to small variations in flow distribution of the injection holes or slight offsets in the direction of the gas flow. The purge gas flow from at least two independently controlled injectors can be set to tend to balance out injector flow effects to minimize such gas flow biasing.

In FIG. 1, although not to scale, the two turbulent injector sections 20-1 and 20-2 each have a single row of gas discharge holes. The holes are spaced apart by one-half of the width of the opening of the container type being purged. All of the holes of an injector are at least a distance of the dimension of two tunnel opening heights (the height is the minimum dimension shown in FIG. 1) away from any tunnel opening. As described above, the preferred distance is not less than twice the smallest dimension of the closest tunnel opening.

A laminar gas flow injector 26 is also located within the tunnel adjacent its roof. Laminar flow means a flow which is smooth and has little or no turbulence. The laminar injector 26 can be constructed by any of the known techniques for producing laminar flow. One such technique is to introduce the gas through a porous cylinder. The cylinder can have any convenient diameter dimension.

The laminar injector 26 can be located anywhere inside the tunnel. It can straddle, that is, be cross-wise to, a tunnel entrance or exit opening. The laminar injector is preferably located near the tunnel exit opening. The highest purity gas concentration is required near the tunnel exit opening where the oxygen concentration within an exiting container 12 is lowest. That is, most of the air has already been purged from an exiting container. In the tunnel shown in FIGS. 1 and 2, a single laminar injector 26 is located lengthwise of the tunnel near its exit 16. The distance of the end of the laminar injector 26 from the closest adjacent tunnel opening is preferably at least one-half of the smallest dimension of said nearest tunnel opening. The length of the laminar injector is preferably twice the height of the tunnel exit opening 16.

The total purge gas flow rate for the purge tunnel 10 is equal to the sum of the laminar flow plus turbulent flow gases. The laminar flow is typically equal to about 90% of the total flow and the turbulent flow is typically about 10%.

The minimum total purge gas flow rate for the tunnel is that required to prevent air from infiltrating through the tunnel entrance and exit openings 14, 16. This is most easily determined by monitoring the oxygen level near the tunnel entrance and exit while varying the laminar flow rate with the turbulent flow rate set to zero.

To demonstrate the invention, a tunnel with 4" wide by 7" high entrance and exit openings and of a length of 95" was purged with room temperature nitrogen through a laminar injector. The turbulent purge gas flow was zero. The laminar purge gas flow was injected uniformly along the length of the tunnel. The flow at each opening was about equal. The oxygen levels measured at the entrance and exit openings of the tunnel versus laminar purge gas flow rate are indicated in Table I below.

TABLE I

| Laminar Purge Gas Flow (cfh $N_2$) | $O_2$ % at Entrance | $O_2$ % at Exit |
|---|---|---|
| 1,080 | 15 | 20 |
| 2,062 | 3.1 | 2.5 |
| 3,034 | 0.3 | 0.1 |

A minimum of 1,500 cubic feet per hour (cfh) from the laminar flow was required at each opening to prevent air infiltration such that the tunnel oxygen content was less than 1%. The total minimum purge gas flow rate in this example is therefore 3,000 cfh.

The total laminar purge gas flow directed towards the entrance opening may have to be larger than the minimum in order to dilute the oxygen content of the air carried in by the containers. The flow required to dilute the incoming air to a given level is given by the equation:

$$\text{Entrance flow} = \frac{C - O_2}{O_2} * \text{Can_air_flow}$$

Entrance flow is the total purge gas flow exiting the entrance opening of the tunnel, C is the percent concentration of oxygen in air, e.g. 20.9 volume percent, $O_2$ is the desired oxygen level at the entrance, and Can_air_flow is the rate of air flow carried by the containers into the tunnel.

It is desired that at the entrance to the tunnel, the oxygen concentration should be less than C, preferably less than 10% and most preferably less than 2%.

In the tunnel example referred to above, 8,000 cfh of $N_2$ is required for the tunnel entrance opening in order to dilute the incoming air carried by the containers to 2% when 600 containers per minute enter the tunnel, each container containing 0.25 cubic feet of air. The total purge gas flow required for the tunnel then becomes 9,500 cfh or 8,000 cfh for the entrance plus 1,500 cfh for the exit.

It is preferable to have active flow biasing in the turbo-laminar flow tunnel to ensure that the proper amount of flow is directed to each tunnel opening. Several known techniques for flow biasing are suitable. A preferred technique is described in U.S. Pat. No. 4,920,998, *Method and Apparatus for Controlling Flow Bias in a Multiple Zone Process,* by Deitrick, et al., incorporated by reference. In this technique, the bias is measured by introducing a tracer gas into the flow directed towards a particular tunnel opening. The flow rate towards the opening is determined from the concentration of the tracer gas downstream of the injection point according to the equation:

$$\text{Opening flow} = \frac{100}{\text{Tracer\%}} * \text{Tracer_Flow}$$

where Opening flow is the purge gas flow rate directed towards a given tunnel opening, Tracer % is the concentration of the tracer gas expressed as %, and Tracer_flow is the flow rate of tracer gas.

The flow rate towards a given tunnel opening can be controlled by controlling a directional jet of purge gas directed towards or away from said opening to maintain a desired Tracer %. Such a directional gas jet 38 is shown in FIG. 1 near the middle of the tunnel. It is preferably controlled from a separate gas source so that its flow rate can be controlled.

It was discovered that a preferred technique for controlling the flow bias in a purge tunnel where significant air is carried in by the containers is to monitor the oxygen level at both the tunnel entrance and exit. The directional jet 38 is controlled by the measured oxygen level difference between the entrance and exit readings. When the difference is too high, there is insufficient purge gas flow to the entrance and the gas flow bias to the entrance is increased by directing the flow from nozzle 38 toward the entrance. When the difference is too low, there is excess flow to the entrance and the bias to the entrance is decreased by directing purge gas flow from jet 38 toward the tunnel exit or reducing bias gas flow toward the entrance. In general, more bias flow toward the entrance is required than toward the exit since the incoming containers carry a significant amount of oxygen and the movement of the containers tend to bias the flow toward the exit. The system described responds properly in the extreme case where significant air infiltrates into the exit opening and flows to the entrance. The oxygen level at the exit will be much larger than the oxygen level at the entrance and the bias to the entrance will be appropriately decreased. This technique may also be employed in processing systems which do not employ the turbo-laminar purge of this invention.

It was also discovered that another technique for controlling the total flow to any purged tunnel where significant air is carried in by the containers is to monitor the oxygen level at both the tunnel entrance and exit. The laminar flow to the tunnel is controlled by the sum of the oxygen level at the entrance and exit. When the sum is high, there is inadequate total flow, and the laminar flow is increased. When the sum is low, there is excess flow and the total flow is decreased.

A preferred control system combines the flow bias and total flow control as described above. This control system may also be employed in processing systems which do not employ the turbo-laminar purge of this invention.

The turbulent flow should be sufficiently high to remove the air from the containers being purged during the time they are in the tunnel. Too low a turbulent purge gas flow rate will give inadequate container purging. Too high a turbulent flow rate will cause air infiltration at the tunnel openings or product disturbance.

To determine turbulent flow parameters the aforesaid purging tunnel (4" wide by 7" high openings and 95" length) was used. A porous metal laminar injector was installed along the entire length of the tunnel near its roof. A turbulent injector in two sections, each 33.5" long and placed end to end was also installed along the length of the tunnel. Each section had a single row of 1/32" diameter holes spaced 1/2" apart. There was 14" distance between each tunnel opening and the nearest hole in a turbulent injector section. This was 3.5 times the minimum dimension of the smallest dimension of the opening (4" width) High purity nitrogen (<10 PPM $O_2$) was used for both the turbulent and laminar flow purge flow.

Cylindrical shaped cans, 3" in diameter and 3, 4, 5 or 6" high, of potato crisps were passed through the tunnel. The residence (total passage) time of each can in (through) the tunnel was 10 seconds. After the cans passed through the tunnel, they were sealed and the residual oxygen in the cans was measured. For this application it was desired to reduce the oxygen content in the containers to 1.5% or less. The results are given in Table II.

TABLE II

| Can Height inches | $O_2$ in Cans for 3677 cfh Laminar Flow 0 cfh Turbulent Flow | $O_2$ in Cans for 14096 cfh Laminar Flow 0 cfh Turbulent Flow | $O_2$ in Cans for 3034 cfh Laminar Flow 600 cfh Turbulent Flow |
|---|---|---|---|
| 3 | 1.70% $O_2$ | 0.45% | 1.32% $O_2$ |
| 4 | 4.76% $O_2$ | 1.37% | 1.18% $O_2$ |
| 5 | 4.68% $O_2$ | 1.67% | 0.85% $O_2$ |
| 6 | 5.49% $O_2$ | 2.03% | 0.94% $O_2$ |

In the absence of turbulent flow, even with as high as about 14,000 cfh of laminar purge gas flow, the larger containers could not be adequately purged. When the turbulent gas flow was 600 cfh, however, only about 3600 cfh of total purge gas flow was required to lower the oxygen level in all containers to less than 1.5%. Surprisingly, the purging was even more effective for the larger containers than it was for the smaller ones. More turbulent flow is required with a shorter residence time of the cans in the tunnel. Also, a greater turbulent flow would be required if the turbulent injector holes were larger or more numerous.

There must be at least enough laminar flow to prevent air infiltration through the tunnel entrance and exit when there is no turbulent flow and also to dilute the air carried in by the containers. Higher levels of laminar purge gas flow may be required when high turbulent flow rates are used. High turbulent flow rates cause some air infiltration through the tunnel openings despite their distance from said openings. The total amount of laminar flow required to prevent air infiltration is then proportional to the turbulent flow.

The necessary ratio of laminar to turbulent flow is determined by routine experimentation for a particular application. High ratios are required when the turbulent injector has small or few holes. The total amount of laminar flow required, however, is independent of turbulent injector hole size or number. The increased ratio caused by small turbulent injector holes is balanced by the smaller turbulent flow volume due to the small holes.

Both the ratio of laminar to turbulent purge gas flow and the total amount of laminar flow increase as the turbulent injector is moved closer to a given tunnel opening. With a higher turbulent flow rate the turbulent injector holes should be spaced further from the adjacent tunnel opening.

In the tunnel represented in Table II, laminar and turbulent flows were varied. Oxygen levels were measured at the tunnel entrance and exit. Table III below shows the results. There were no containers in the tunnel.

TABLE III

| | $O_2$ for 4380 cfh Laminar Flow | $O_2$ for 6047 cfh Laminar Flow | $O_2$ for 8164 cfh Laminar Flow |
|---|---|---|---|
| 400 cfh Turbulent Flow | 0.0015% $O_2$ | 0.0004% $O_2$ | 0.004% $O_2$ |
| 711 cfh Turbulent Flow | 1.4% $O_2$ | 0.0005% $O_2$ | 0.004% $O_2$ |
| 1036 cfh Turbulent Flow | 10% $O_2$ | 2.5% $O_2$ | 0.004% $O_2$ |

A ratio of laminar to turbulent flow of at least 6:1 was required to maintain oxygen levels of less than 2% for this tunnel and turbulent injector design.

The turbo-laminar purge gas flow concept can be used to purge the air from the spaces between adjacent products in a conveyor line prior to their being individually wrapped in a-packaging machine such as a horizontal form-fill-seal machine. This is particularly advantageous where the wrapping is to be tight around the product. In existing systems, the air is purged from between the product by injecting turbulent flow purge gas between the packaging film and the product. When the wrapping is tight, there is no room for the turbulent flow gas injector. A horizontal form-fill-seal machine wraps product with packaging film, seals the film around the product and then seals and cuts the ends of the film to make individual packages.

FIG. 3 diagrammatically shows a horizontal form-fill-seal packaging machine 40 and a purging tunnel 41 using a turbo-laminar gas purge. Packages 32 to be wrapped in film 42 from a roll are fed into the entrance 43 of the purging tunnel 41 which has a turbulent injector and a laminar injector. The purging tunnel 41 removes any air carried in by the product. The products 32 leave the tunnel and are wrapped with the packaging film to form wrapped product 45.

Additional purge gas can be injected between the product and film 42 if there is room for a gas injector, such as 44, either of the turbulent or laminar flow type at the tunnel exit. For example, a laminar gas flow can be injected through a porous cylinder used for injector 44. An injector of this type has an advantage in reducing skewing or fluttering of the film. This makes for a smoother wrap of the film and a reduction in pockets of trapped gas between the film and the packages and crinkles in the wrapped film, and has applications independent of the present purging tunnel, i.e. even in conventional tunnels wherein such films are employed.

Figure 4:
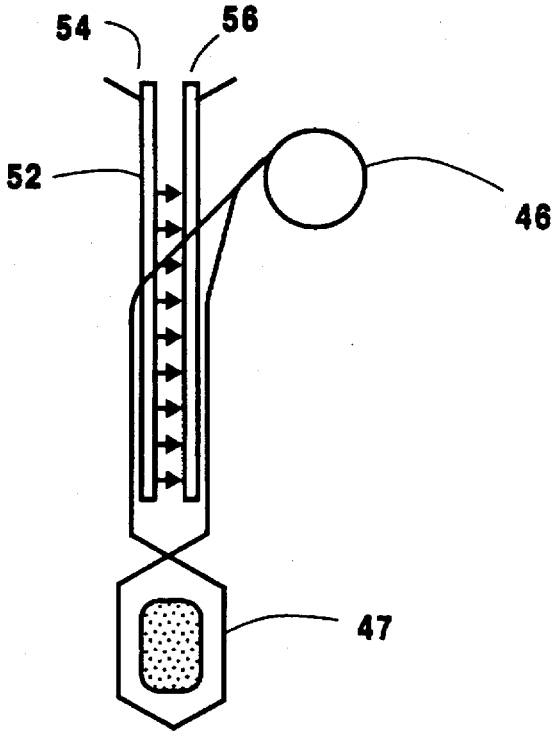
FIG. 4 is a diagrammatic view of a vertical form fill packaging system with air purging.

The turbo-laminar concept can be applied to injecting gas in the former tube of a vertical form-fill-seal machine. A vertical form-fill-seal machine is similar to a horizontal form-fill-seal machine except that bulk product, such as potato chips, is dropped in vertically. In this embodiment the form-fill-seal machine comprises the processing zone and the residence time is the time the bulk product takes to pass through this processing zone. As shown in FIG. 4, such a machine has a normally cylindrical former tube 52 which the packaging film 46 wraps around as it is formed into a bag. The product is dropped into the top of the tube 52 into an open package formed by the film being wrapped. Within the former tube 52 is a turbulent injector 54 which injects purge gas along the length of he processing zone, i.e. former tube 52. A laminar injector 56 located within the former tube injects purge gas near the bottom of the former tube 52. Here also, a process cylinder can be used for the laminar flow injector. This permits the use of a high gas flow without causing low weight products falling through the vertical tunnel to levitate, i.e., to be blown up toward the top of the tunnel. After the product falls to the bottom of former tube 52,. sealed product 47 is formed; the film is pulled down and a seal is made, such as by heat or ultrasonic sealing, to form the top of the package. The sealing also forms the bottom of the next package.

Figure 5:
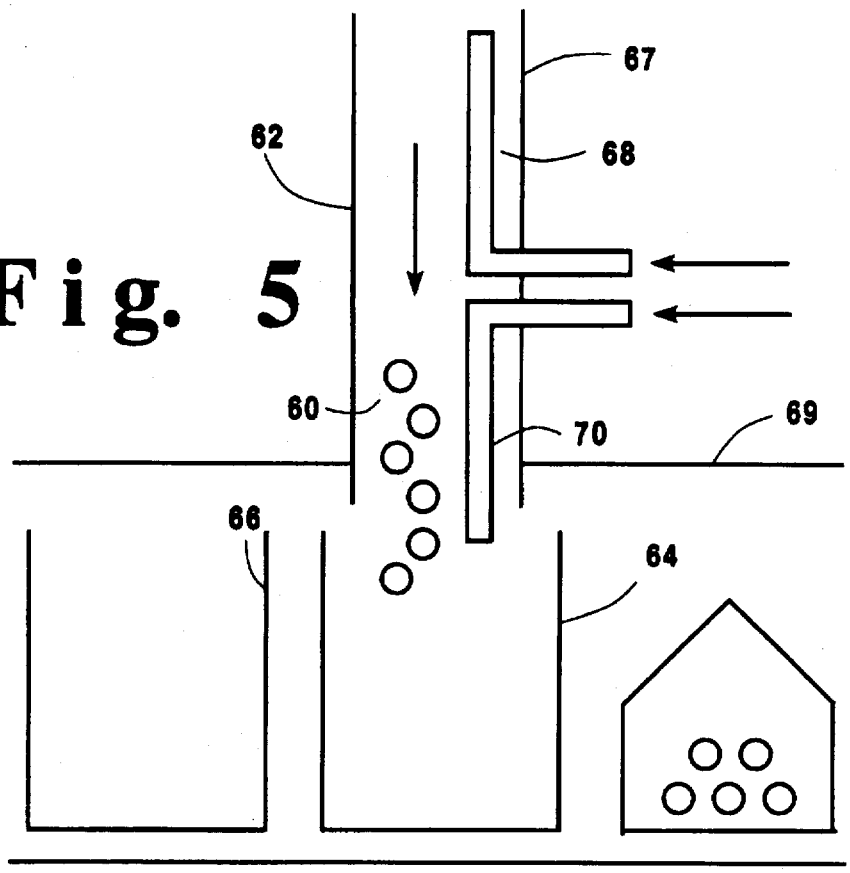
FIG. 5 is a diagrammatic view of a system for packaging of bulk products and for purging the air in the packages.

Both turbo-laminar purging and laminar-only purging are beneficial for packaging machines that load product vertically into open containers that can be either rigid or flexible. Vertical loading machines drop product through a filler tube into an open container. The container then moves horizontally to a sealing station. The filling and sealing station may be in a tunnel, such as is shown by tunnel 69, but need not be in a tunnel. FIG. 5 shows a vertical fill machine for bulk product 60, e.g., peanuts, candy, etc., that is dispensed through a filler tube 62 into an open container 64 below the tube exit 66.

Gas is injected laminarly into the feed tube 60 by an injector 68 located along the length of the feed tube 60 closer to its entrance end 67 to prevent infiltration of air into tube 62. The combination of using a laminar flow gas purge in the feed tube and passing the product through a purge tunnel is superior to a purge tunnel alone. The laminar purge injector 68 within the feed tube 62 is preferably an annular collar of porous metal (not shown) as described in commonly assigned patent application Ser. No. 08/286,200, filed Aug. 8, 1994. The collar is slightly larger than the feed tube to prevent the product from striking the porous metal as it falls.

A turbulent flow purge injector 70 located within the filler tube 62 has its outlet jet pointed directly into the open package 64. In this embodiment the processing zone comprises the filler tube and the filling station and the residence time is the time the container takes to traverse the filling station. The combination of a laminar purge 68 within the tube and turbulent purge 70 at the outlet, as shown in FIG. 5, was shown to be effective in a test application where the bulk product 60 was dried fruit and the package 64 was flexible. The invention may be practiced with two different purge gases wherein one purge gas has a greater density or specific gravity, i.e. is heavier, than the other purge gas. When a heavy gas (e.g., argon) was injected laminarly above a turbulent light gas (e.g., $N_2$), lower oxygen levels were attained in the container 64 than when either only argon or only $N_2$ was used for both the laminar and turbulent gas. The stratification benefit of the two purge gases of different density was also observed when a light gas ($N_2$) was injected laminarly below a laminar heavy gas. The preferred arrangement uses laminar injection for the heavy gas and turbulent injection for the light gas in accordance with this invention.

Figure 6:
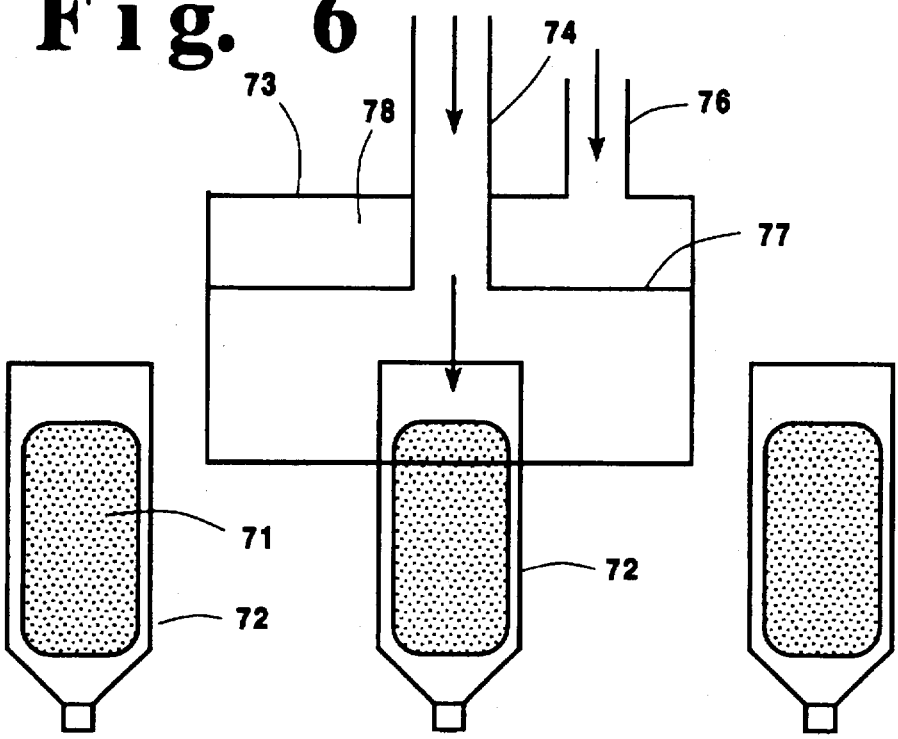
FIG. 6 is a diagrammatic view of a system for purging air from containers using a turbo-laminar purge gas flow.

FIG. 6 shows a system that eliminates the need for keeping the purged containers in a tunnel as they move from a filling station to the sealing station. In the arrangement shown in FIG. 6, a creme product 71 (e.g., hair creme) is put in an open container 72 (like a toothpaste tube) in a filling station by any suitable apparatus (not shown). The container 72 then moves to a flushing station 73 where the air remaining in the container head space above the creme product is purged by a turbulent purge provided through an injector 74 as it passes through the flushing station. The container then moves to a sealing station where the end is crimped closed by any suitable apparatus (not shown). In this embodiment the processing zone comprises the flushing station and the residence time is the time the container takes to traverse the flushing station.

The head space of the product container 72 is protected from air as it is being flushed in the station 73 by a laminar purge of gas provided from a source conduit 76 that flows into the flushing station 73. Inert gas is introduced into a plenum 78 in the flushing station and distributed uniformly as a laminar flow by a sheet of porous metal 77. The porous metal sheet 77 is preferably wider than the open containers but it can be as narrow as ½ of the width of the open containers.

Both the laminar flow and turbulent flow are necessary. Known systems use a turbulent flow of gas from the filling station to the sealing station to protect the head space of the product container. The turbulent flow was generated by flowing gas through an array of holes drilled in a solid sheet of metal on the bottom of the plenum. Known systems also do not use a turbulent purge at the flushing station. Oxygen levels of 10% are achieved with conventional known systems. Oxygen levels of less than 2% are attainable for a filling station with the turbo-laminar purge of this invention even when no enclosed tunnel is employed.

Specific features of the invention are shown in one or more of the drawings for convenience only, as each feature may be combined with other features in accordance with the invention. Alternative embodiments will be recognized by those skilled in the art and are intended to be included within the scope of the claims.

We claim:

1. A method for purging air from a container comprising:

(A) passing a container having an open part through a processing zone during a residence time said processing zone having an entrance point and an exit point;

(B) passing a laminar flow of purge gas through the processing zone toward at least one of the entrance point and the exit point while the container is within the processing zone;

(C) injecting a turbulent flow of purge gas into the processing zone; and (D) exposing the open part of said container to the turbulent flow of purge gas within the processing zone for at least 50 percent of the residence time.

2. The method of claim 1 wherein the processing zone comprises a tunnel.

3. The method of claim 2 further comprising measuring the concentration of oxygen at the tunnel entrance and exit and controlling the gas flow in response to the difference between the two measured concentrations of oxygen.

4. The method of claim 1 wherein the purge gas having the laminar flow is heavier than the purge gas having the turbulent flow.

5. The method of claim 4 wherein the purge gas having the laminar flow comprises argon and the purge gas having the turbulent flow comprises nitrogen.

6. The method of claim 4 wherein the purge gas having the laminar flow and the purge gas having the turbulent flow form two stratified gas layers within the processing zone.

7. Apparatus for purging air from a container comprising:

(A) a processing zone having an entrance point and an exit point;

(B) means for passing a container having an open part through the processing zone from the entrance point to the exit point during a residence time;

(C) means for providing a laminar flow of purge gas through the processing zone toward at least one of the entrance point and the exit point; and (D) means for injecting a turbulent flow of purge gas into the processing zone such that the open part of the container is exposed to the turbulent flow of purge gas within the processing zone for at least 50 percent of the residence time.

8. The apparatus of claim 7 wherein the processing zone comprises a tunnel.

9. The apparatus of claim 7 wherein the processing zone comprises a former tube.

10. The apparatus of claim 7 wherein the processing zone comprises a filling station.

11. The apparatus of claim 7 wherein the processing zone comprises a flushing station.

12. The apparatus of claim 7 further comprising film wrap means proximate the exit point for wrapping film around the container exiting the processing zone.

13. The apparatus of claim 12 further comprising means for providing purge gas between the film and the container exiting the processing zone.

* * * * *